US005202554A

United States Patent [19]

Wilton et al.

[11] Patent Number: 5,202,554

[45] Date of Patent: Apr. 13, 1993

[54] METHODS OF AND APPARATUS FOR SEPARATING AND DETECTING SHEETS

[75] Inventors: Christopher G. L. Wilton, Hampshire; Colin A. Langstone, Portsmouth, both of England

[73] Assignee: De La Rue Systems Limited, England

[21] Appl. No.: 708,690

[22] Filed: May 31, 1991

[30] Foreign Application Priority Data

Jun. 1, 1990 [GB] United Kingdom ..... 9012204
Feb. 4, 1991 [GB] United Kingdom ..... 9102338

[51] Int. Cl.[5] ..... H01J 40/14

[52] U.S. Cl. ..... 250/222.2; 271/161

[58] Field of Search ..... 250/222.2, 223 R; 377/53, 8; 271/161, 19, 25, 95, 145

[56] References Cited

U.S. PATENT DOCUMENTS

| | | | |
|---|---|---|---|
| Re. 27,869 | 1/1974 | Willits et al. . | |
| 3,422,274 | 1/1969 | Coan . | |
| 3,581,067 | 5/1971 | Willits et al. . | |
| 3,661,431 | 5/1972 | Wisecarver . | |
| 3,663,803 | 5/1972 | Mohan et al. . | |
| 3,692,980 | 9/1972 | Getker et al. . | |
| 3,790,759 | 2/1974 | Mohan et al. . | |
| 3,813,523 | 5/1974 | Mohan et al. . | |
| 3,835,306 | 9/1974 | Bills et al. | 377/8 |
| 3,862,402 | 1/1975 | Igarashi et al. | 235/92 |
| 3,983,367 | 9/1976 | Kondó et al. | 377/8 |
| 4,149,319 | 4/1979 | Nelle . | |
| 4,232,218 | 11/1980 | Kenton et al. . | |
| 4,373,135 | 2/1983 | Mohan et al. | 377/8 |
| 4,384,195 | 5/1983 | Nosler . | |
| 4,532,421 | 7/1985 | Sasaoka et al. | 377/8 |
| 4,547,674 | 10/1985 | Pryor et al. . | |
| 4,694,474 | 9/1987 | Dorman et al. . | |
| 4,771,443 | 9/1988 | Mohan et al. . | |
| 4,828,367 | 5/1989 | Curbelo et al. . | |
| 4,846,589 | 7/1989 | Chikuma et al. . | |
| 4,912,317 | 3/1990 | Mohan et al. . | |
| 4,978,845 | 12/1990 | Hill . | |
| 4,994,666 | 2/1991 | Higgison et al. . | |
| 4,995,060 | 2/1991 | Hill . | |
| 5,005,192 | 4/1991 | Duss . | |
| 5,017,773 | 5/1991 | Sato . | |
| 5,040,196 | 8/1991 | Woodward . | |
| 5,046,076 | 9/1991 | Hill . | |
| 5,082,363 | 1/1992 | Nakanishi et al. . | |
| 5,087,119 | 2/1992 | Kaneko et al. . | |

FOREIGN PATENT DOCUMENTS

| | | | |
|---|---|---|---|
| 2639677 | 9/1978 | Denmark . | |
| 1023610 | 12/1964 | United Kingdom . | |
| 1541368 | 2/1979 | United Kingdom . | |
| 0098385 | 5/1983 | European Pat. Off. . | |
| 0422563 | 8/1990 | Fed. Rep. of Germany . | |
| 0112537 | 6/1985 | Japan | 271/161 |
| 61-272892 | 12/1986 | Japan . | |
| 1-321593 | 12/1989 | Japan . | |
| 2-168372 | 6/1990 | Japan . | |
| 2-291090 | 11/1990 | Japan . | |

OTHER PUBLICATIONS

Patent Abstracts of Japan, vol. 10, No. 114 (M-473) (2171), Apr. 26th, 1986 & JPA-60,242,149.

Patent Abstracts of Japan, vol. 9, No. 268 (M-424) (1991), Oct. 25th, 1985.

Patent Abstracts of Japan, vol. 14, No. 369 (P-1090) (4312), Aug. 9, 1990.

Soviet Inventions Illustrated, week 8840, Nov. 16th, 1988, Class TO5, Access No. N88-215903, Derwent Publications Ltd., London, GB.

"MQ Laser Analog Sensor (Class I/Class IIIb)", Technical Manual, Aromat, 1989.

*Primary Examiner*—David C. Nelms
*Assistant Examiner*—Que T. Le
*Attorney, Agent, or Firm*—Ostrolenk, Faber, Gerb & Soffen

[57] ABSTRACT

The sheets within a stack of sheets are separated by clamping one end of the stack, bending the other end, clamping the other end and then unbending the stack. A radiation beam such as a laser beam is then directed at the stack of separated sheets, the beam reflecting from the edges of the sheets. The reflected signal is sensed by a photodetector which converts the received intensity into an electrical signal which is then fed to a processor, such as a microprocessor, to count the number of sheets.

19 Claims, 8 Drawing Sheets

METHODS OF AND APPARATUS FOR SEPARATING AND DETECTING SHEETS

FIELD OF THE INVENTION

The invention relates to a sheet detection device, sheet stack holding means, and methods for separating sheets.

DESCRIPTION OF THE PRIOR ART

An operation which is commonly required when handling sheets, such as banknotes, is to count the number of sheets which exist in a stack. Conventionally, a stack of sheets is placed in an input hopper of a counting machine and subsequently sheets are individually picked off the stack and fed through the machine past a detection device which monitors the passage of the sheet and increments a counter accordingly. The sheets are then restacked downstream of the detection device. Each of the operations involved in such a counter: separation of sheets from the stack, feeding past the detection device, and restacking involves a separate mechanical operation which is susceptible to break down and jamming.

In another method a bundle of notes retained within its strap is clamped so that one end of the bundle is held against a rotating spindle head which picks and bends the end of the individual notes for counting purposes. The machines using this technique do not count the notes directly but count the number of rotations of spindles whilst sensing the presence of a vacuum level. Notes are picked by vacuum sucking.

SUMMARY OF THE INVENTION

In accordance with one aspect of the present invention, a sheet detection device comprises a radiation beam source; sheet stack holding means for holding a stack of sheets so that edges of the sheet are presented to the radiation beam from the source; and detection means for detecting radiation after impingement on the stack.

We have devised a new type of detection device, which is particularly suitable for use in counting machines, in which the sheets are individually detected within a stack without the need to separate the stack into separate sheets.

In the preferred arrangement, the detection means monitors radiation reflected by edges of the sheets, peaks in the reflected intensity corresponding to reflection from the sheet edge. In other applications, however, the detection means could monitor radiation transmitted through the stack between adjacent sheets.

The radiation beam source can have any conventional form providing a beam is generated which is sensitive to the material of the sheets, usually paper. Typically, the beam source comprises a laser which generates a radiation beam in the optical or infra-red range.

The device may further comprise focusing means for focusing the radiation beam onto the sheet edges.

The detection means will typically comprise a photodetector, such as a photo diode or linear CCD array.

In some examples, the beam and stack are relatively moveable so that the beam can scan across the sheet edges. The scanning action can be achieved in a variety of ways. For example, the sheet stack holding means may be moveable relative to the remainder of the device; or the path of the radiation beam could be moved, for example using mirrors or the like.

In other examples a static system is provided in which the device further comprises a beam spreader for causing the beam to have a dimension corresponding to the thickness of the stack.

In order to increase discrimination between sheets we provide in accordance with a second aspect of the present invention a method of separating sheets within a stack, the method comprising clamping the sheets at one end of the stack; imparting a bend in the stack so that the edges of the sheets separate; clamping the stack at a position remote from the clamped edge; and unbending the stack so that portions of sheets between the clamps separate.

Typically, the unbending step occurs after completion of the second clamping step. However, the clamping and unbending steps could occur together.

We have also devised a novel form of sheet stack holding means which can be used to achieve the separating operation. Thus, in accordance with a third aspect of the present invention, sheet stack holding means comprises a first clamp for clamping one end of a sheet stack; bending means for imparting a bend to a sheet stack clamped in the first clamp; and a second clamp for clamping the stack at a position remote from the first clamp, the first and second clamps being relatively movable to impart an unbending motion on the stack so as to separate portions in the stack between the clamps.

Preferably, the second clamp is moveable between an initial, open position in which the relative position of sheets within the second clamp can vary during the bending operation, and a second, closed position in which the sheets are held in their relative positions after bending.

This very simple series of movements leads to the central portions of the sheets in the stack fanning open so as to make the edges of individual sheets easily detectable.

BRIEF DESCRIPTION OF THE DRAWINGS

Some examples of methods and apparatus according to the invention will now be described with reference to the accompanying drawings, in which.

DETAILED DESCRIPTION OF THE EMBODIMENTS

Figure 2:
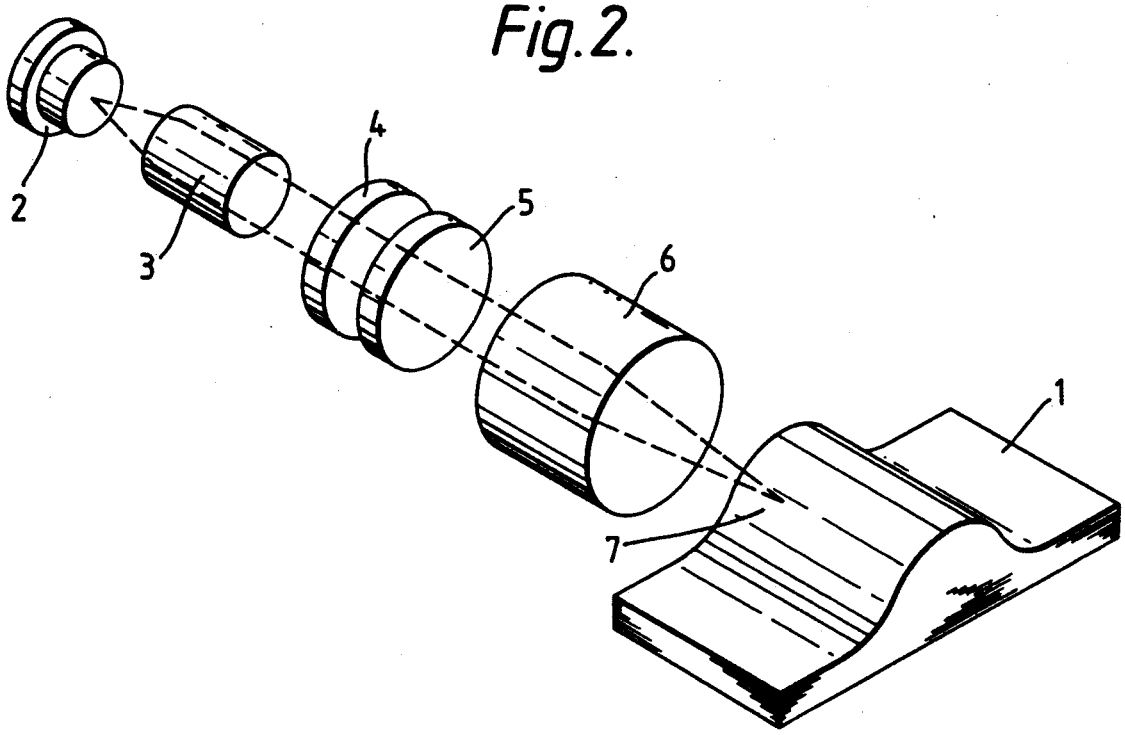
FIG. 2 is a schematic block diagram of one example of the apparatus.

One example of apparatus according to the invention is shown in FIG. 2. A stack of sheets such as banknotes is held at 1. A laser diode 2 generates a laser beam which is fed to collimating optics 3 and thereafter through a polarizer 4 and quarter wavelength plate 5 (both of which are optional) to focusing optics 6. The beam is focused at a point 7 which lies on a plane defined by the edges of the notes in the stack 1.

Figure 3:
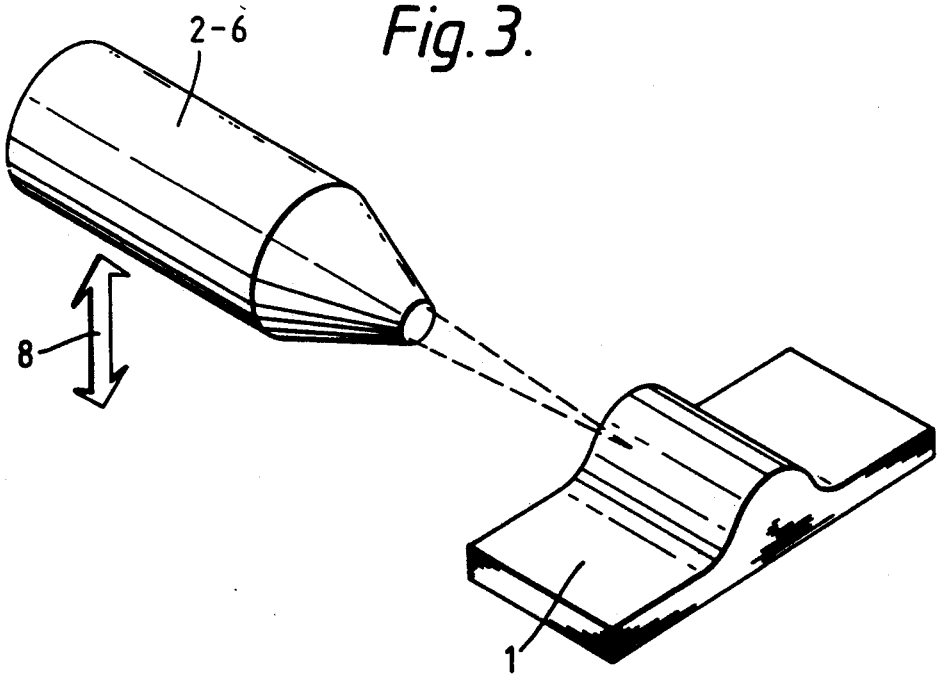
FIG. 3 is a plan of the FIG. 2 example.
Figure 4:
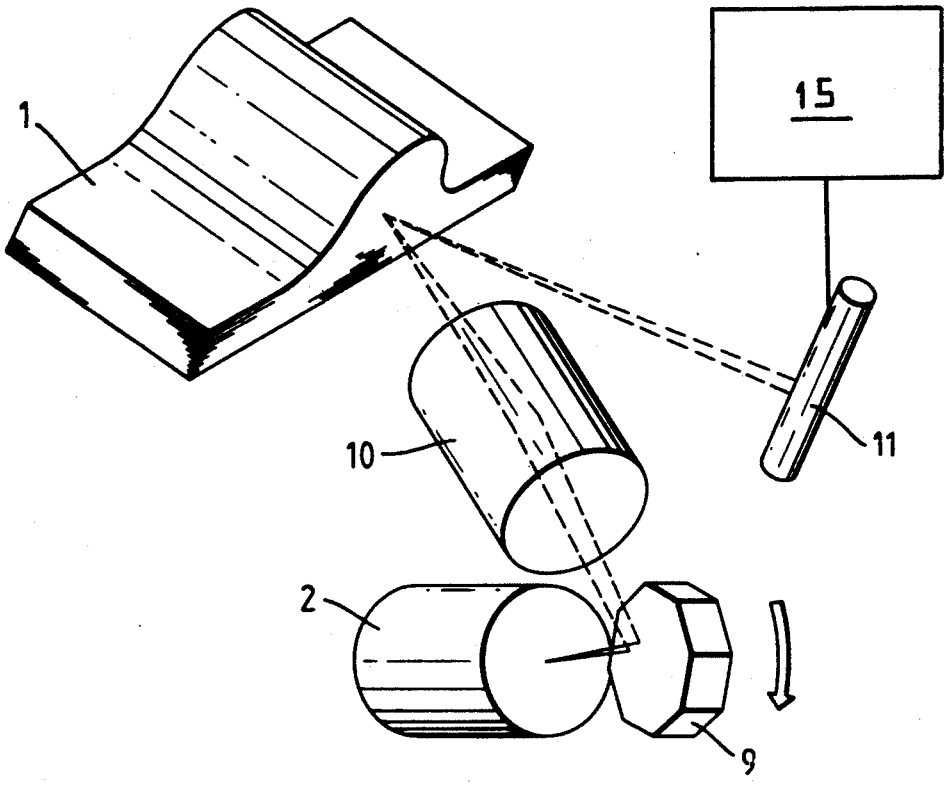
FIG. 4 is a block diagram of a second example of the apparatus.
Figure 5:
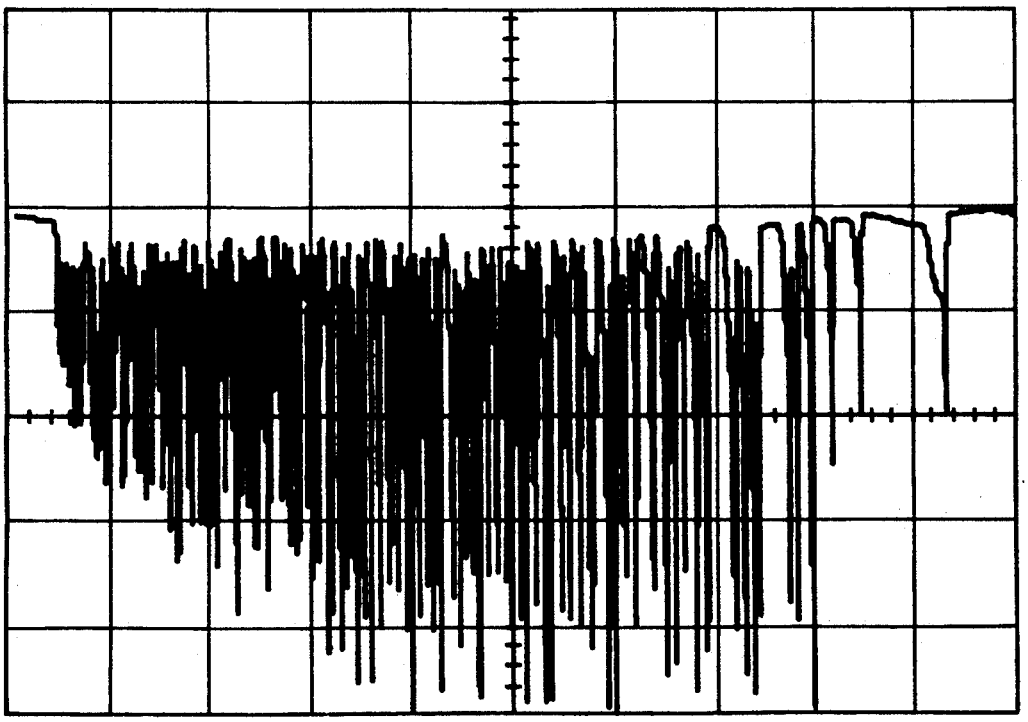
FIG. 5 illustrates the detected signal.

In operation, in this example, the laser diode 2 is scanned relative to the stack 1 (as can be seen in FIG. 3) in the directions of the arrows 8. As the beam scans across the edges of the notes in the bundle, it will be reflected strongly by the edge of each sheet but otherwise is at least partially absorbed. The reflected signal is detected by a photodetector (not shown) which converts the received intensity into an electrical signal which is then fed to a processor (also not shown). The form of the electrical signal can be seen in FIG. 5. The processing electronics can then analyse the signal, for example by thresholding, digitizing etc to isolate those parts of the signal which correspond to sheet edges and thereafter count those edges to determine the number of sheets in the stack FIG. 4 illustrates an alternative system for scanning the beam across the sheet stack 1. In this case, a multifaceted wheel 9 is provided between the laser diode 2 and focusing optics 10, the wheel 9 rotating to cause the beam regularly to scan across the sheet bundle 1. In this example, the photodetector 11 is shown onto which reflected radiation impinges, the detector being connected to a microprocessor 15 to enable the received signal to be analysed. Although the method of scanning shown in FIG. 4 leads to higher speeds and multiple scans being achievable; it has the disadvantage of the large depth of focus necessary in order that the beam remains in focus across the width of the bundle and the associated loss in resolution which results in a long depth in focus.

Typically, the laser diode will generate a radiation beam of 670 nm although beams at longer and shorter wavelengths are also suitable provided that the output power and wavelength does not damage the sheets. The output power of the laser diode preferably ranges from 0 to 5 mW, in continuous wave, modulated or pulsed operation.

Figure 6A:
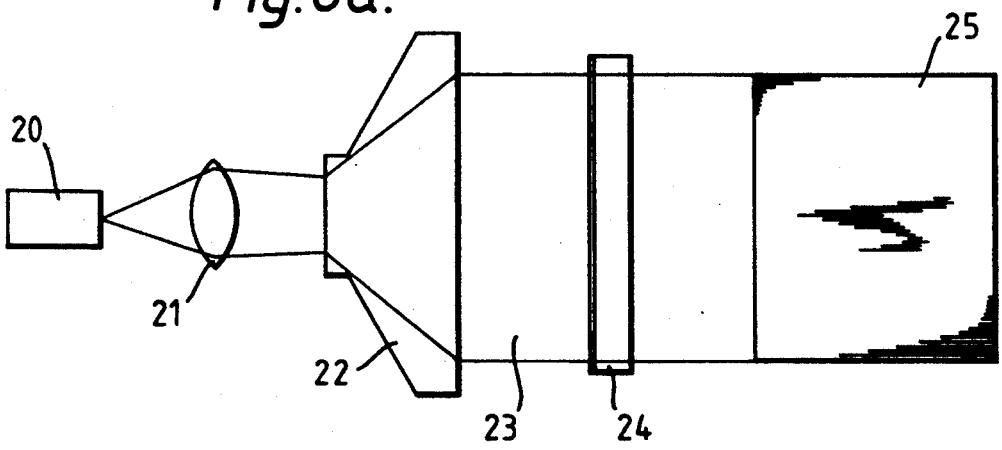
FIG. 6A and 6B are a plan and side view respectively of a third example of the apparatus.
Figure 6B:
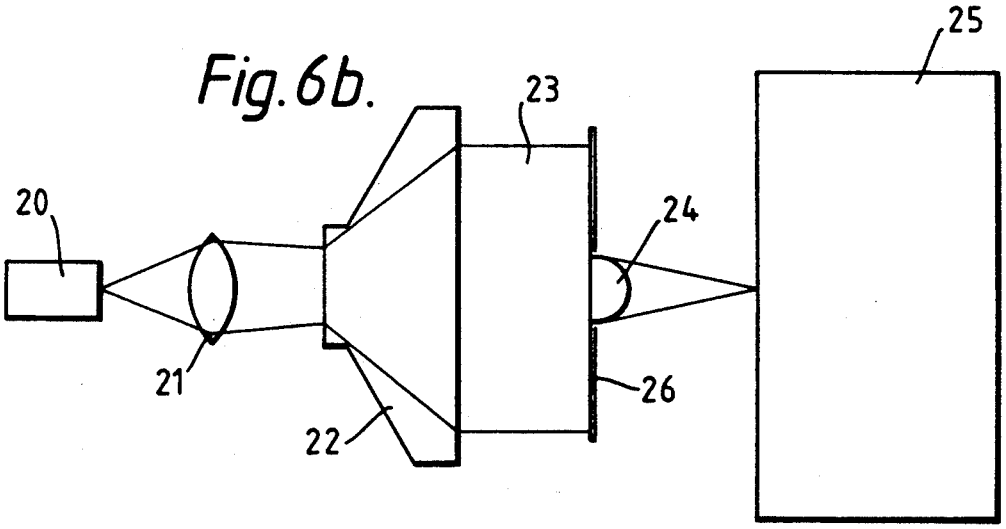
Figure 7:
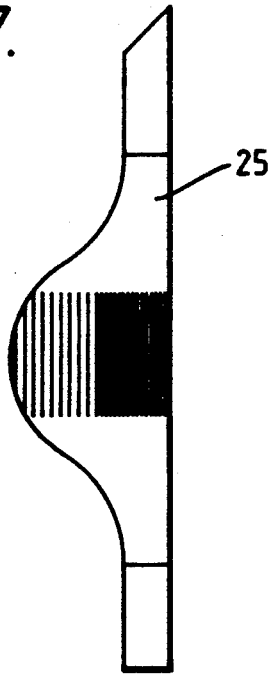
FIG. 7 illustrates illumination of a not by the apparatus shown in FIG. 6.

FIG. 6 illustrates apparatus embodying an alternative approach where instead of causing relative scanning movement, a static system is provided. A laser beam from a source 20 is collimated by a collimating lens 21, the collimated beam being fed to a beam expander 22. The expanded, collimated beam 23 is focused by a long cylindrical lens 24 onto the edges of the note stack 25. A light guard 26 is positioned about the lens 24 which itself is optional. The size of the expanded beam should be just greater than the maximum thickness of the note bundle or stack in its preformed state. The apparatus thus produces a thin beam across the whole thickness of the note bundle 25 (FIG. 7). Because the beam is still collimated in the plane parallel to the notes, there will be no reflections from the internal surfaces of the notes and only reflections from each note edge. As an alternative, the illumination could be achieved using an LED strip i.e. approximately 5–20 LEDs along a single line, each LED having about 7° angle of illumination.

This thin strip of light can then be imaged onto a linear CCD. A suitable linear CCD is manufactured by Sony and has 5000 pixels, each pixel being 7 micron wide. Thus, the system shown in FIG. 6 provides a much greater resolution than that of the apparatus shown in FIGS. 2 and 4 which make use of a focused laser spot which typically has a dimension of 75 microns. The scanning process is carried out electronically by clocking out the data from the CCD.

As mentioned above, the cylindrical lens 24 is not essential and a slit would be as effective although this would reduce optical intensity.

Figure 1A:
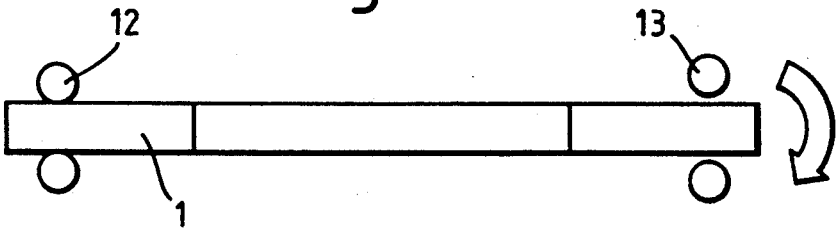
FIGS. 1A–1D illustrate a sequence of operations required to fan a stack of notes.
Figure 1B:
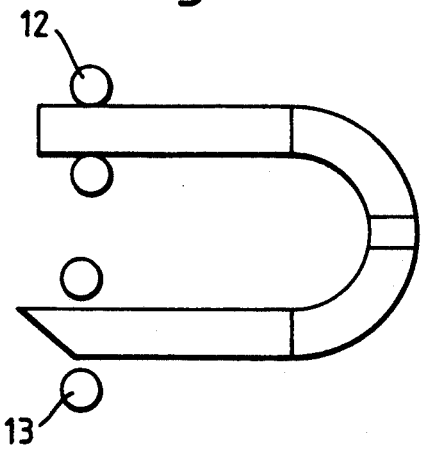
Figure 1C:
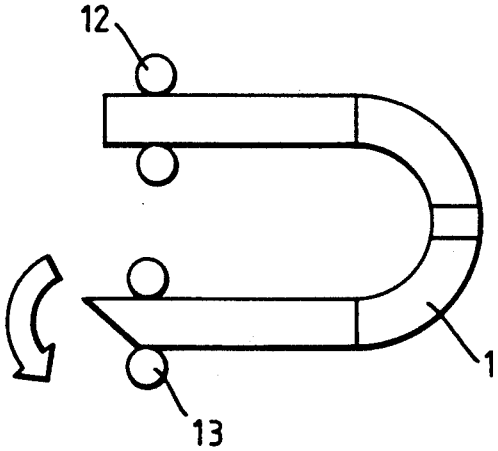
Figure 1D:
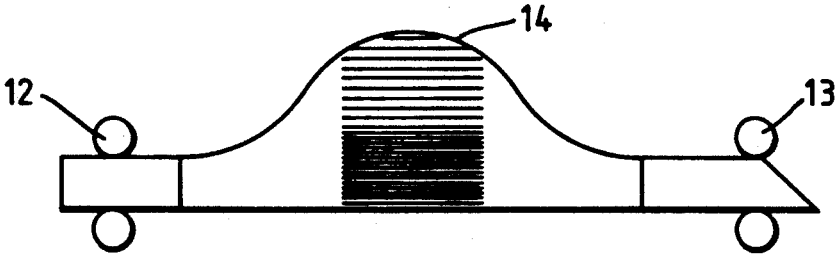

Although the resolution obtainable from a laser diode is considerable there is the danger of damaged note edges or notes sticking together causing a reduction in the accuracy of the system. For this reason it is desirable to separate the notes sufficiently so that the gap between each note is such that a laser diode beam can distinguish between each note edge. One method for achieving this separation is shown in FIG. 1. The sheet stack 1 is positioned so as to extend between a pair of clamps 12, 13. The clamp 12 is closed to hold one edge of the stack while the clamp 13 is left open (FIG. 1A). The clamp 13 is then rotated through 180° relative to the clamp 12 (FIG. 1B) and then the clamp 13 is closed (FIG. 1C). It can be seen in FIGS. 1B and 1C that this rotation has caused the free edges of the sheets to fan apart. The clamp 13 is then rotated back to its initial position (FIG. 1D) and it will be seen that this rotation, due to the fact that the clamp 13 is closed, has caused the central portions of the sheets in the stack to fan upwards by different amounts 14 so that their edges are relatively widely spaced apart for subsequent detection. In general this fanning movement will be followed by the scanning process. However, the fanning movement itself could be used to cause the notes to scan across the laser beam. In some cases, the clamp 13 could be rotated back beyond its original position.

Figure 8A:
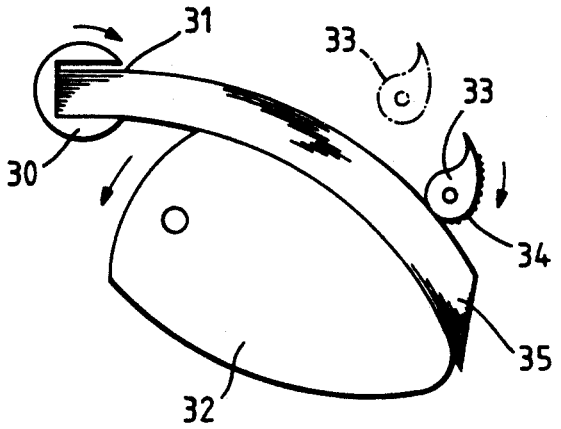
FIGS. 8A and 8B illustrate a first example of stack holding apparatus in two different positions.

Some examples of apparatus for achieving the scanning movement will now be described. The example shown in FIG. 8 comprises a roller 30 having a blind slot 31. This forms a first clamp as will be explained below. A second clamp is formed by a cooperating cam 32 and profiled clamp roller 33. The clamp roller 33 carries corrugated rubber matting 34. Initially, a bundle of notes carrying a band is positioned in the slot 31 with the band moved to that end of the stack. At that point the clamp roller 33 is in its raised position 33'. The clamp 33 is then moved to the position shown in solid lines in FIG. 8A so that it just contacts the bundle of notes 35 and holds them lightly against the surface of the cam 32.

Figure 8B:
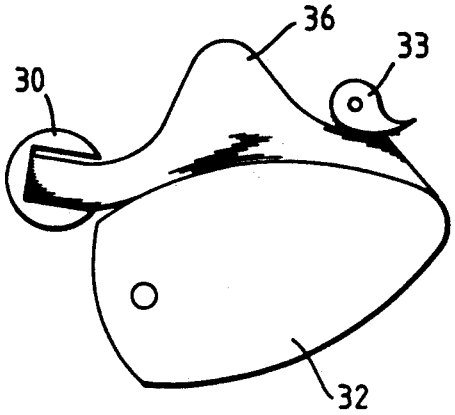

The cam 32 is then rotated in an anti-clockwise direction pushing the note bundle 35 upwards. The profiled roller 33 rotates simultaneously as a result of the cam action until a point is reached at which it will rotate no longer and firmly clamps the bundle against the cam surface as shown in FIG. 8B. During cam rotation, the acceptor roller 30 tilts slightly to provide some clamping force to the other end of the note bundle.

The combination of these actions will cause a slight separation of the central portion 36 of the note bundle which is sufficient for the number of notes to be counted by laser scanning.

The apparatus needed to cause rotation of the various components is not shown but will be readily envisaged by a person of ordinary skill in the art. The apparatus could be actuated manually or using pneumatics or motor drives. The profiled clamp 33 enables automatic adjustment (within limits) to be achieved for different thicknesses and quantities of notes.

Figure 9:
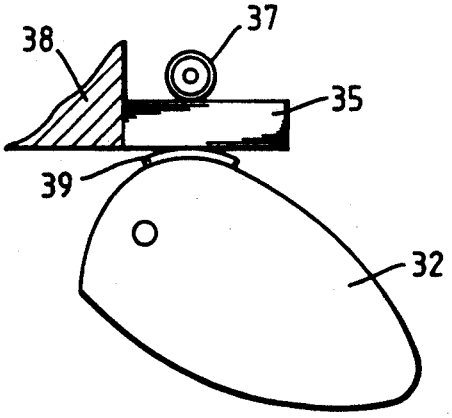
FIG. 9 illustrates an alternative form of clamp for use with the apparatus shown in FIG. 8.

FIG. 9 illustrates an alternative to the acceptor roller 30 for use in a clamping system as described above with respect to FIG. 8. In this case, the roller 30 is replaced with a rubber coated feed roller 37 and stop 38. Clamping is achieved by the profile of the cam 32 and is aided by corrugated rubber matting 39 on the surface of the cam. This modification may be particularly useful when feeding a note bundle into the apparatus.

Figure 10A:
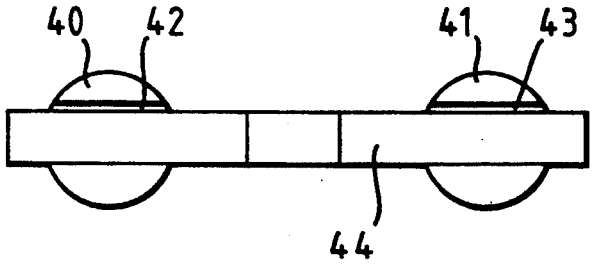
FIGS. 10A and 10B illustrate a second example of stack holding apparatus in different positions.

FIG. 10 illustrates a second example of a stack holding apparatus which comprises a pair of slotted rollers 40,41 each having an elongate slot 42,43 respectively. In use, the band (not shown) on a bundle of notes 44 is moved to one end and that end of the bundle is inserted into the slot 42 of the roller 40. The other end of the bundle is inserted into the slot 43 of the roller 41. The ends of the bundle in each slot 42,43 are then clamped. There are number of possible methods for clamping some of which are shown in FIG. 11. FIG. 11A illustrates the use of a cleat 45 which tightens down onto the note bundle 44 as the roller rotates.

Figure 11A:
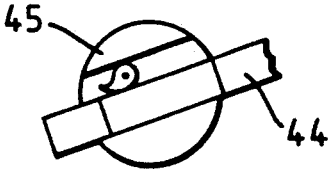
FIGS. 11*a–c* illustrate three different examples of clamping means for use with the apparatus shown in FIG. 10.
Figure 11B:
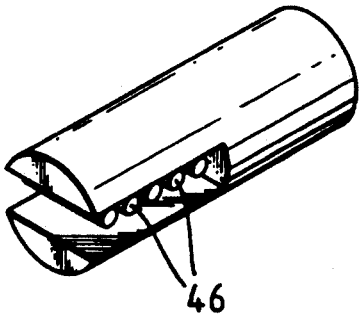

FIG. 11B illustrates the use of rubber coated, spring mounted wheels 46 which rotate freely about their axes to accept a note bundle when inserted. This insertion also moves the wheels against the spring action so the wheels will clamp the bundle.

Figure 11C:
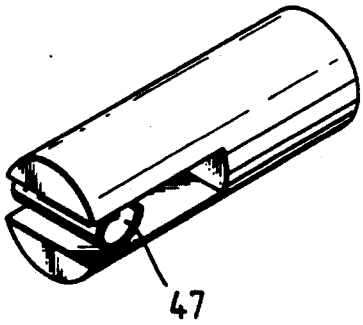

FIG. 11C illustrates the use of a rubber coated leaf spring 47 which accepts and clamps a note bundle 44 when inserted.

Figure 10B:
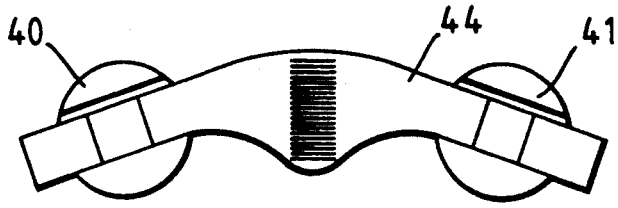

When the note bundle 44 is firmly clamped, the slotted rollers 40,41 are then rotated in opposite directions through an angle of about 45° as shown in FIG. 10B. Simultaneously the rollers are moved towards each other against a spring action in order to accommodate the tension in the note bundle. This combination of actions results in a slight separation of the notes in the centre of the note bundle such that they can be counted by laser scanning.

Figure 12A:
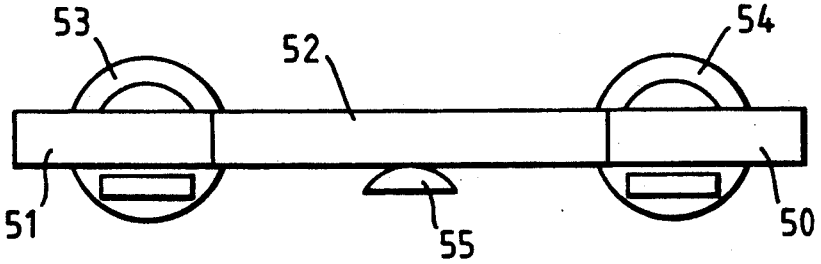
FIGS. 12A–12C illustrate a third example of stack holding apparatus in different positions.

FIG. 12 illustrates a further example of sheet stack holding apparatus. In this example, a sheet stack 50 is positioned to extend through slots 51,52 in a pair of spaced rollers 53,54. The band around the bundle is moved to one end of the bundle as before. At this point (FIG. 12A) the clamps within the rollers 53,54 are not operational.

As can be seen in FIG. 12, the bundle of notes 50 rests on a centrally positioned lifting bar 55.

Figure 12B:
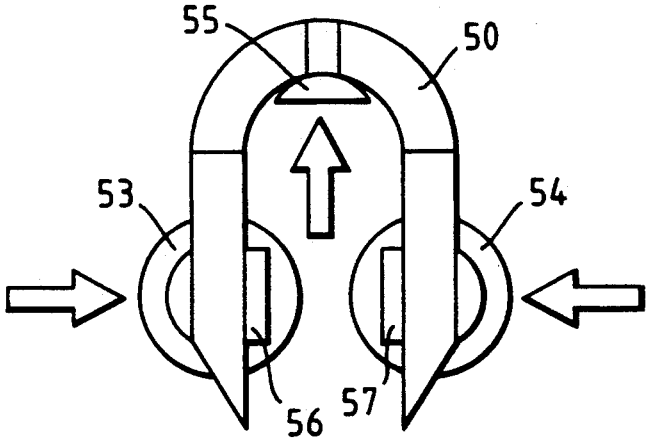

The lifting bar 55 is actuated so that it rises relative to the positions of the rollers 53,54 while the rollers themselves are simultaneously moved inwards against spring action as shown in FIG. 12B. The rollers 53,54 will pivot in response to this movement which results in imparting a U-shaped fold to the note bundle 50. At this stage, the clamps 56,57 in the rollers 53,54 are actuated.

Figure 12C:
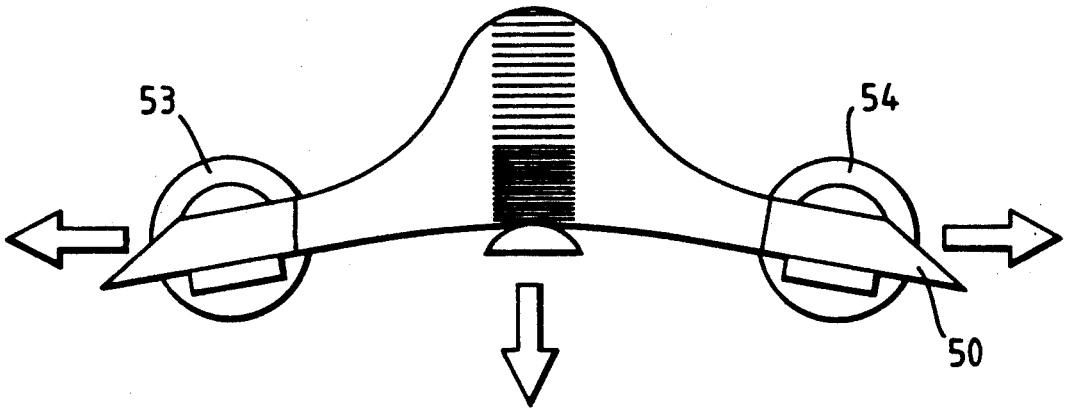

The lifting bar 55 then returns to its original position and the rollers 53,54 also return to their original positions under the action of the springs (not shown) so that the note bundle takes up the form shown in FIG. 12C. As can be seen in FIG. 12C, this operation results in a slight separation of the central portion of the notes in the bundle.

The lifting bar 55 can be actuated by means of a motor driven ball screw or roller screw or any other suitable mechanism.

Figure 13:
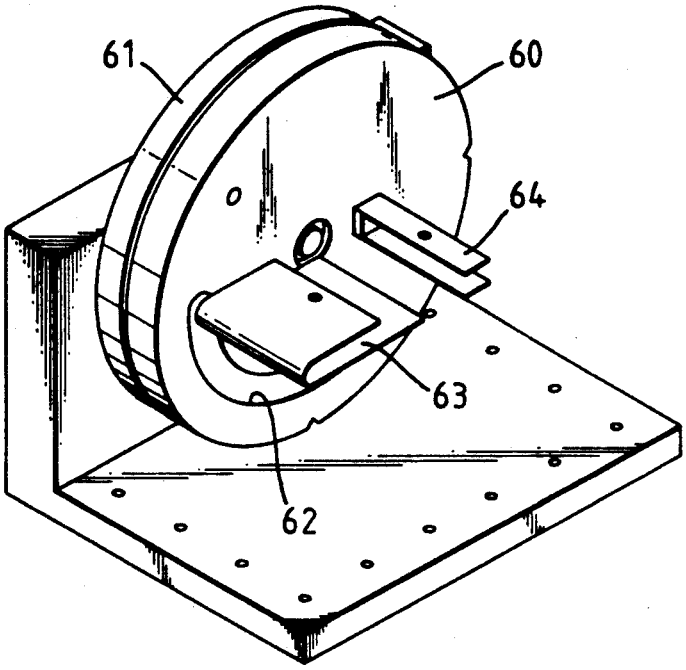
FIG. 13 illustrates a fourth example of a stacking holding apparatus.
Figure 14A:
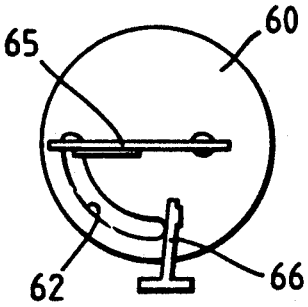
FIGS. 14A–14C illustrate the FIG. 13 apparatus in operation.
Figure 14B:
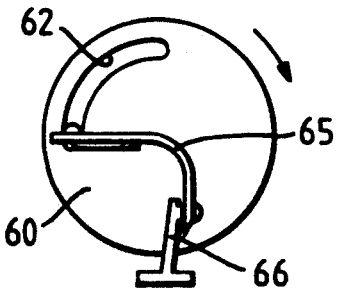

FIGS. 13 and 14 illustrates a mechanism which consists of two discs 60,61 mounted on a common axis, one immediately behind the other. The front disc 60 has an annular dot 62 around one of its quadrants. The rear of two discs 60, disc 61 has a note bundle clamp 63 which projects through the slot 62 in the front disc 60 in order to hold one end of a bundle of notes in front of the front disc 60. Another note clamp 64 holds the other end of the note bundle and is attached to the front disc 60.

A bundle of notes 65 (FIG. 14) is inserted between the two note clamps 63, 64 but is only gripped positively by the clamp 63 attached to the rear disc 61 (FIG. 14A), i.e. the notes are supported but free to move in the clamp 64 attached to the front disc 60.

Formation of the note bundle to the required profile is achieved by rotating the front disc 60 through 90° clockwise relative to the rear disc 61 until the note clamp 64 contacts an independent stop 66 also serves to provide positive clamping on the formed note bundle which now makes clamping effective at both ends of the bundle.

Figure 14C:
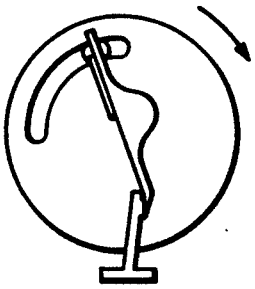

At this stage, the rear wheel 61 rotates through 90° clockwise relative to the front wheel 60 (FIG. 14C). Then secondary action forms the note bundle 65 into the required profile which gives the note separation necessary for scanning.

We claim:

1. A method of detecting sheets within a stack, the method comprising causing portions of sheets in a sheet stack to separate between the ends of the stack; causing a radiation beam to impinge on said separated portions of said sheets; and detecting the presence of respective sheets by monitoring the radiation after impingement on said stack.

2. A method according to claim 1, wherein the sheet separation step comprises clamping said sheets at one end of said stack; imparting a bend in the stack so that said edges of said sheets separate; clamping the stack at a position remote from the clamped end; and unbending said stack so that portions of sheets between said clamps separate.

3. A method according to claim 1, further comprising causing relative scanning movement between said radiation beam and said separated portions of said sheets.

4. Apparatus for detecting sheets within a stack, comprising means for causing portions of sheets in a sheet stack to separate between the ends of the stack; means for causing a radiation beam to impinge on said separated portions of said sheets; and detection means for detecting the presence of respective sheets by monitoring the radiation after impingement on said stack.

5. Apparatus according to claim 4, wherein said means for causing portions of said sheets to separate comprises a first clamp for clamping one end of a sheet stack; bending means for imparting a bend to said sheet stack; and a second clamp for clamping said stack at a position remote from said first clamp, said first and second clamps being relatively movable to impart an unbending motion on aid stack so as to separate portions in said stack between said clamps.

6. Apparatus according to claim 5, wherein said second clamp is moveable between an initial, open position in which the relative position of sheets within said second clamp can vary during a bending motion, and a second, closed position in which said sheets are held in their relative positions said after bending motion.

7. Apparatus according to claim 5, wherein said bending means can impart a 180° fold to said stack.

8. Apparatus according to claim 5, wherein said second clamp comprises a cooperating cam and roller between which said sheet stack is inserted, rotation of said cam causing said sheet stack to clamp against said roller and cause portions of said sheets between said first and second clamps to separate.

9. Apparatus according to claim 5, wherein said second clamp comprises a slotted roller through which said sheet stack can extend, and clamping means for holding said sheet stack in a slot of said slotted roller whereby rotation of said slotted roller causes a bending motion and said unbending motion.

10. Apparatus according to claim 9, wherein said clamping means comprises one of a cleat, clamping wheels, and a leaf spring.

11. Apparatus according to claim 5, wherein said bending means further comprises a lifting member positioned between said first and second clamps for imparting said bend in a portion of said stack betweens aid first and second clamps.

12. Apparatus according to claim 4, wherein said radiation beam and said stack are relatively moveable so that said beam can scan across said sheet edges.

13. Apparatus according to claim 12, further comprising a radiation beam source, wherein said stack holding means is moveable relative to said beam source to achieve a scanning movement.

14. Apparatus according to claim 12 said device further comprising beam scanning means for causing said beam to scan across a stack held by said sheet stack holding means.

15. Apparatus according to claim 4, further comprising a beam spreader for causing said beam to have a dimension corresponding to a thickness of said stack.

16. Apparatus according to claim 4, wherein said detection means is arranged to detect radiation reflected from said sheets.

17. Apparatus according to claim 4, further comprising a laser for generating said radiation beam.

18. Apparatus according to claim 4, wherein said detection means comprises a photodetector.

19. Apparatus according to claim 4, further including processing means connected to said detection means for monitoring an output signal from said detection means corresponding to said detected radiation to determine the presence of sheet edges and for counting the number of sheet edges detected.

* * * * *